US007985017B2

(12) United States Patent
Quan et al.

(10) Patent No.: US 7,985,017 B2
(45) Date of Patent: Jul. 26, 2011

(54) LUMINAIRE HAVING PLUG-IN STYLE ELECTRICAL CONNECTOR, AND A SEPARATELY PLUG-IN MOUNTABLE MOTION DETECTOR OR OTHER ACTUATION DEVICE

(75) Inventors: Jon Fong Quan, Foothill Ranch, CA (US); Michael D. Faubert, Foothill Ranch, CA (US); Michael G. Kreeger, Foothill Ranch, CA (US)

(73) Assignee: Hampton Products International Corporation, Foothill Ranch, CA (US)

( * ) Notice: Subject to any disclaimer, the term of this patent is extended or adjusted under 35 U.S.C. 154(b) by 589 days.

(21) Appl. No.: 11/319,036

(22) Filed: Dec. 27, 2005

(65) Prior Publication Data

US 2006/0193151 A1 Aug. 31, 2006

Related U.S. Application Data

(60) Provisional application No. 60/640,109, filed on Dec. 28, 2004.

(51) Int. Cl.
*F21V 23/06* (2006.01)

(52) U.S. Cl. ..... 362/659; 362/657; 362/658; 362/647

(58) Field of Classification Search ..... 362/659, 362/657, 658, 647, 640, 642; 307/147, 157; 439/537

See application file for complete search history.

(56) References Cited

U.S. PATENT DOCUMENTS

| | | | | |
|---|---|---|---|---|
| 3,382,355 | A * | 5/1968 | Prifogle et al. | 362/641 |
| 3,695,009 | A * | 10/1972 | Osteen | 96/147 |
| 4,367,417 | A * | 1/1983 | Casasanta | 307/147 |
| 4,475,226 | A * | 10/1984 | Greenberg | 381/300 |
| 4,721,480 | A * | 1/1988 | Yung | 439/527 |
| 6,641,278 | B1 * | 11/2003 | Guritz | 362/148 |
| 6,780,049 | B1 * | 8/2004 | D'Angelo et al. | 439/537 |
| 6,956,493 | B1 * | 10/2005 | Youngblood | 340/693.9 |
| 6,962,498 | B2 * | 11/2005 | Kohen | 439/21 |

* cited by examiner

*Primary Examiner* — Sharon E Payne

(57) ABSTRACT

A luminaire including a light source mounted on a base having a plug-in style connector attached to the internal wires of the luminaire for supplying AC power to the light source. The connector is adapted to mate with a plug-in style connector connected to wires of a J-box. The luminaire may include a second connector for connecting to a conditional actuation device. If the conditional actuation device is not used, a continuous actuation device may be connected to the luminaire. A method of installing a luminaire includes connecting an electrical connector to the wires for connection to a J-box, connecting the luminaire connector to the electrical connector, and mounting the luminaire onto the J-box. A method of selling includes providing a choice from among different style luminaires, providing a choice from among different actuation devices to connect with the selected luminaire, and optionally selling the selected luminaire and actuation device. Methods of replacing and repairing an actuation device are also disclosed.

66 Claims, 14 Drawing Sheets

LUMINAIRE HAVING PLUG-IN STYLE ELECTRICAL CONNECTOR, AND A SEPARATELY PLUG-IN MOUNTABLE MOTION DETECTOR OR OTHER ACTUATION DEVICE

CROSS-REFERENCE TO A RELATED APPLICATION

This application claims the benefit of the filing date of Provisional Patent Application, Ser. No. 60/640,109, filed on Dec. 28, 2004, and entitled "Outdoor Luminaire Having Plug-in Style Electrical Connector, Self-Aligning Mounting Base, and Separately Mountable Motion or Other Type Sensor," which is incorporated herein by reference.

FIELD OF THE INVENTION

This invention relates generally to lighting fixtures ("luminaires"), and in particular, to a luminaire having a plug-in style electrical connector, and an optional separately mountable motion detector, sensor or other type of actuation device.

BACKGROUND OF THE INVENTION

FIG. 1 illustrates a side view of a conventional luminaire 100. The luminaire 100 is typically used in outdoor security and non-security applications. In particular, the conventional luminaire 100 consists of a light source 102, a base 104, and a neck member 106 connecting the light source 102 to the base 104. It shall be understood that some luminaire design integrate the base 104 with the light source 102 in a manner that the neck member 106 is not required. The conventional luminaire 100 further includes three (3) wires 110*a-c* for connecting respectively to the line, common and ground wires 154*a-c* of an alternating current (AC) power source, by way of respective twist-on wire connectors 156*a-c*. The base 104 is typically secured to a mount 150 using one or more screws 108 threaded into corresponding holes 152 of the mount 150.

It is recognized in the relevant art that the installation of the conventional luminaire 100 can be challenging, time consuming, and expensive. First, an installer has the difficult task of simultaneously supporting the luminaire 100 while connecting the luminaire wires 110*a-c* to the AC power source wires 154*a-c* using the twist-on wire connectors 156*a-c*. Second, the space between the base 104 of the luminaire 100 and the mount 150 is typically relatively small, further making it difficult to properly connect the luminaire wires 110*a-c* to the AC power source wires 154*a-c*. Third, because the base 104 hampers the installer's view of the mount 150, it is often difficult for the installer to properly align the mounting screws 108 of the luminaire 100 to the corresponding threaded holes 152 of the mount 150. Such difficulties add to the challenge, time, and labor costs associated with the installation of the conventional luminaire 100.

With regard to conventional luminaires that have a single mounting screw at the center of the base, there is a tendency for such luminaires to rotate easily. This may result in the luminaire not having the most desirable orientation on the mount. For Halogen tubular lamp styles, the lamp may move away from the required horizontal position. Such lamps typically are required to operate in a horizontal position (e.g., within 2 degrees from true horizontal) in order to obtain normal operating life.

Finally, with regard to the flexibility in customizing conventional luminaires, consumers are typically limited to a particular style of luminaire connected to a particular style of actuation device (e.g., motion sensor, ambient light sensor, timer, etc.). Generally, there is not much flexibility in allowing a consumer to select a particular style of lighting fixture in combination with a desired actuation device.

SUMMARY OF THE INVENTION

An aspect of the invention relates to a luminaire which is configured to facilitate the installation thereof. In particular, the luminaire comprises a light source having a connector attached to wires for supplying alternating current (AC) power to the light source. The luminaire connector is adapted to mate with a corresponding electrical connector. The electrical connector, in turn, is attached to the AC power source wires, such as the line, common, and ground wires, emanating from, for example, a junction box. In this configuration, the installation of the luminaire is relatively simple. First, the electrical connector is connected to the AC power source wires (line, common, and ground). Second, the luminaire connector is then connected (e.g., plugged in) to the electrical connector. Third, the luminaire is mounted onto an appropriate mount (e.g., a junction box or junction box bracket). The connection of the luminaire connector to the electrical connector facilitates the installation of the luminaire; which would otherwise be a relatively difficult task for a single person, who has to make the appropriate connections with twist-on wire connectors while, at the same time, support the luminaire.

A more specific exemplary embodiment of the luminaire includes a base, a light source mounted to the base, and a connector mounted on the base. As discussed above, the connector is attached to the luminaire internal wires for supplying AC power (e.g., line, common, and ground) to the light source, and is adapted to mate with an electrical connector attached to the AC power source wires (line, common, and ground) emanating from, for example, a junction box. The base may include one or more openings to receive one or more threaded screws or bolts for securing the luminaire to a mount (e.g., a junction box or junction box bracket). Such one or more openings are configured to align with corresponding one or more threaded openings of the mount. Additionally, the base includes one or more alignment members (e.g., posts) for facilitating the alignment of the luminaire to the mount, and maintaining the luminaire at proper orientation. The base may further include a connector holder to secure the connector to the base, and remove the connector from the base to facilitate the connection of the connector to the electrical connector. Further, the light source may be pivotally mounted to a neck member extending outwardly from the base. A pivot adjust may be provided for adjusting the orientation of the light source. The luminaire may have several variations including an embodiment with a plurality of light sources.

The luminaire may further include a second connector to which an actuation device may be connected. The actuation device, for example, may include a continuous actuation device, motion detector, ambient light sensor, timer, transmitter, receiver, transceiver or others. The actuation device causes the activation of the luminaire (i.e., turns ON the light source). For example, if the motion detector senses motion in its proximate area, then the motion detector causes the luminaire to turn ON. Or, if the ambient light sensor senses that the ambient light falls below a threshold level, then the ambient light sensor causes the luminaire to turn ON. Similarly, if the timer generates a current time that falls within a predetermined time window, the timer causes the luminaire to turn ON. Also, the transmitter generates and transmits a signal to cause a remote luminaire to turn ON. Additionally, the receiver receives a signal which causes the attached luminaire to turn ON. Further, the transceiver generates and transmits a signal to cause a remote luminaire to turn ON, and receives a signal which causes the attached luminaire to turn ON.

As discussed above, the actuation device may include a continuous actuation device. In such a case, the continuous actuation device (e.g., in the form of a socket cap) is connected to the luminaire, which allows the luminaire to operate normally. In order words, the continuous actuation device completes the luminaire circuit either directly by providing the electrical connection or indirectly by mechanically urging against an internal switch that, in turn, completes the luminaire circuit. In any case, the continuous actuation device causes the luminaire to operate as a conventional luminaire, and may be activated simply by a conventional ON/OFF switch.

It shall be understood that be understood that the actuation device interface connector and associated circuitry of the luminaire may be normally-closed; that is, the circuit is normally complete allowing the luminaire to operate as a conventional luminaire. In such a case, the continuous actuation device is not required. The connection of the conditional actuation device to the luminaire would break the normally-closed circuitry until the conditional actuation device activates the light source upon detecting or sensing one or more predetermined conditions.

As discussed above, the luminaire in accordance with the invention is configured to facilitate the installation thereof. Accordingly, another aspect of the invention relates to a method of installing a luminaire. The method comprises connecting a first connector to AC power source wires (line, common, and ground) emanating from a mount (e.g., a junction box). Then, the first connector is connected to a second connector of the luminaire. The second connector is attached to the luminaire internal wires (line, common, and ground) for supplying AC power to the light source of the luminaire. Then, the luminaire is mounted on the mount (e.g., the junction box).

The luminaires, according to the various embodiments of the invention, are configured to provide consumers the flexibility to custom design their own lighting and security systems. Accordingly, another aspect of the invention relates to a method of selling luminaires and related products to consumers. The method comprises providing a consumer a choice of a luminaire from among a plurality of different luminaires having different style light sources, providing the consumer a choice of an actuation device from among a plurality of different actuation devices to connect with the selected luminaire, and optionally selling the selected luminaire with the selected actuation device to the consumer.

Another aspect of the invention relates to the ease of removing the actuation device from the luminaire to, for example, change the existing actuation device for another type of actuation device or a new actuation device of the same type, or to repair the existing actuation device. In this regard, disclosed is a method of replacing a first actuation device including a first connector connected to a second connector of a luminaire. The method comprises disconnecting the first actuation device from the luminaire by removing the first connector from the second connector; and connecting a second actuation device to the luminaire by connecting a third connector of the second actuation device to the second connector of the luminaire.

Additionally, a method is disclosed for repairing an actuation device including a first connector connected to a second connector of a luminaire. The method comprises disconnecting the actuation device from the luminaire by removing the first connector from the second connector; repairing the actuation device; and connecting the repaired actuation device to the luminaire by connecting the first connector to the second connector.

Other aspects, features, and techniques of the invention will be apparent to one skilled in the relevant art in view of the following detailed description of the exemplary embodiments of the invention.

BRIEF DESCRIPTION OF THE DRAWINGS

FIG. 2F-1 illustrates a plan view of the rear side of the base with a connector holder securely attaching the connector to the base in accordance with another embodiment of the invention;

FIG. 2F-2 illustrates a perspective of the rear side of the base with the connector holder removed, thereby releasing the connector from the base in accordance with another embodiment of the invention;

DETAILED DESCRIPTION OF THE PREFERRED EMBODIMENTS

Figure 2A:
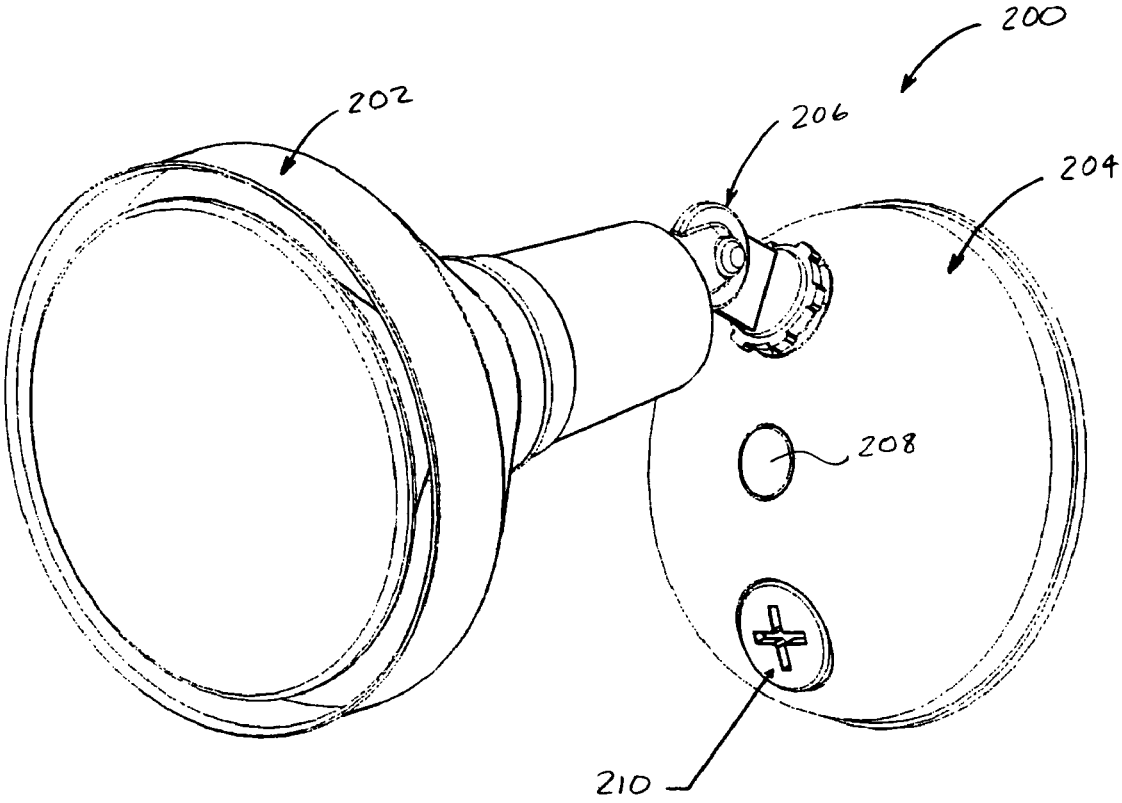
FIG. 2A illustrates a front perspective view of an exemplary luminaire in accordance with an embodiment of the invention.

FIG. 2A illustrates a front perspective view of an exemplary luminaire 200 in accordance with an embodiment of the invention. The luminaire 200 comprises a light source 202, a base 204, and a neck member 206. The base 204 further includes a screw cap 208 and a continuous actuation device 210 (e.g., in the form of a socket cap). In this example, the light source 202 is pivotally mounted on the neck member 206 in order to allow a user to change the direction of the light emanating from the light source 202. The neck member 206, in turn, extends outwardly from the base 204. As discussed in more detail below, the screw cap 208 covers a threaded screw or bolt for securing the luminaire 200 to a mount.

Also, as discussed in more detail below, the continuous actuation device 210 mates with a connector used to receive an actuation device which causes the light source 202 to turn ON. In addition to the continuous actuation device, such actuation devices, for example, include motion detectors, ambient light sensors, timers, transmitters, receivers, transceivers and others. These are examples of conditional actuation devices that activate the luminaire in response to certain conditions, such as detecting motion, sensing the ambient light fall below a threshold, detecting that the current time falls within a predetermined time period, transmitting a signal to activate another luminaire, receiving a signal which causes the activation of the attached luminaire, and both transmitting a signal to activate another luminaire and receiving a signal which causes the activation of the attached luminaire. If the continuous actuation device is used instead of a conditional actuation device, the continuous actuation directly or indirectly completes the circuit allowing the light source 202 to be operated as a typical light fixture.

As previously discussed, the actuation device interface connector and associated circuitry of the luminaire may be normally-closed; that is, the circuit is normally complete allowing the luminaire to operate as a conventional luminaire. In such a case, the continuous actuation device is not required. The cap 210 may be a dummy cap to cover the connector when no actuation device is connected to the luminaire. The connection of the conditional actuation device to the luminaire would break the normally-closed circuitry until the conditional actuation device activates the light source upon detecting or sensing one or more predetermined conditions.

Figure 2B:
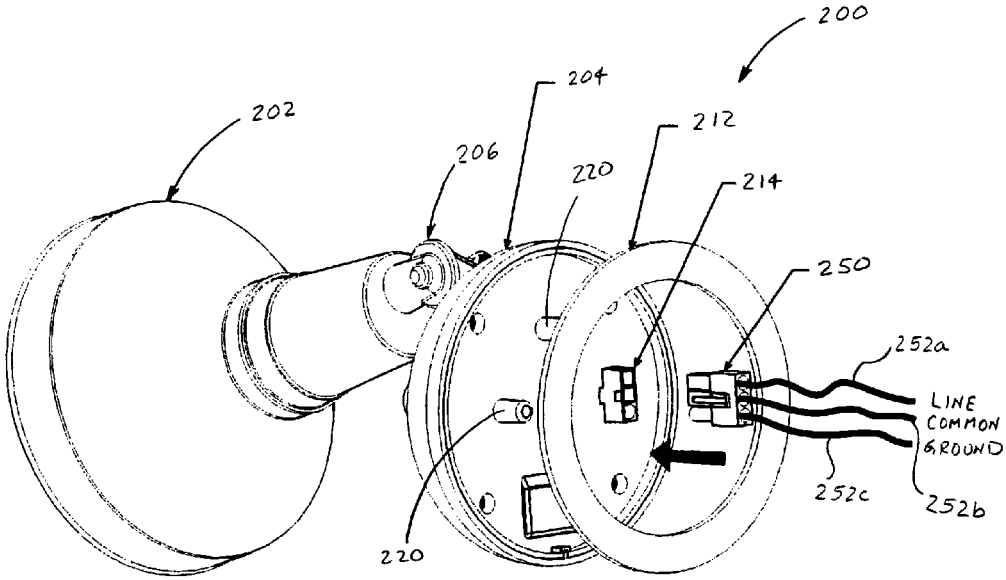
FIG. 2B illustrates a rear perspective view of the exemplary luminaire in accordance with another embodiment of the invention.

FIG. 2B illustrates a rear perspective view of the exemplary luminaire 200 in accordance with another embodiment of the invention. The luminaire 200 further includes a gasket 212 for interfacing the peripheral portion of the base 204 to a mount for water-resistant purposes. Additionally, the luminaire 200 includes a connector 214 connected to the internal wires (line, common, and ground) of the luminaire 200. The connector 214 may be in the form of a socket or other type of connector. The connector 214 is mounted on the rear side of the base 204. A corresponding connector 250 is connected to the alternating current (AC) power source wires 252*a-c* (line, common, and ground). As with the luminaire connector 214, the electrical connector 250 may be in the form of a socket or other type of connector. The luminaire connector 214 is configured to mate with the electrical connector 250.

The installation of the luminaire 200 is made relatively easy as compared to that of the conventional luminaire 100. First, wires 252*a-c* are securely connected to the electrical connector 250. These wires 252*a-c* are, for example, connected to the junction box wires by way of conventional means, for example, twist-on wire connectors. Second, the luminaire connector 214 is then securely mated to the electrical connector 250. Third, as discussed in more detail below, the luminaire 200 is mounted on a mount. In contrast to the conventional luminaire 100, there is no need to perform the difficult task of connecting the AC power source wires directly to the luminaire wires with twist-on wires connectors, in a view-restricted and confined space, while at the same time supporting the luminaire.

Figure 2C:
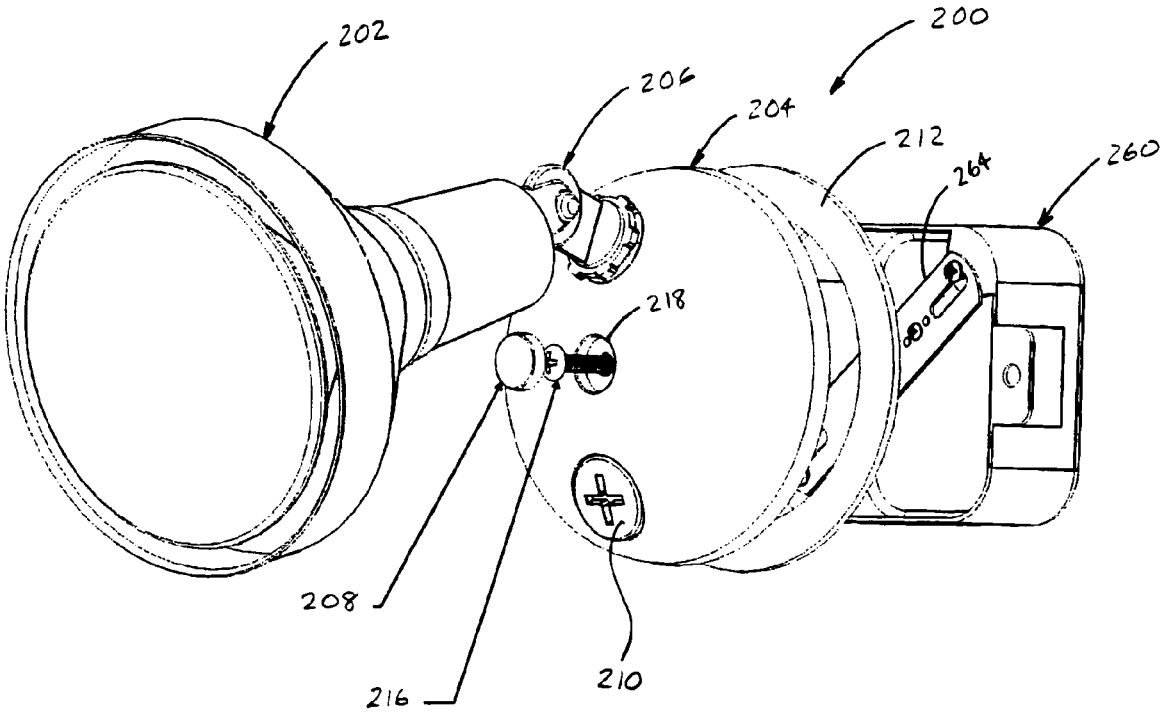
FIG. 2C illustrates a front perspective view of the exemplary luminaire being mounted to a mount in accordance with another embodiment of the invention.
Figure 2D:
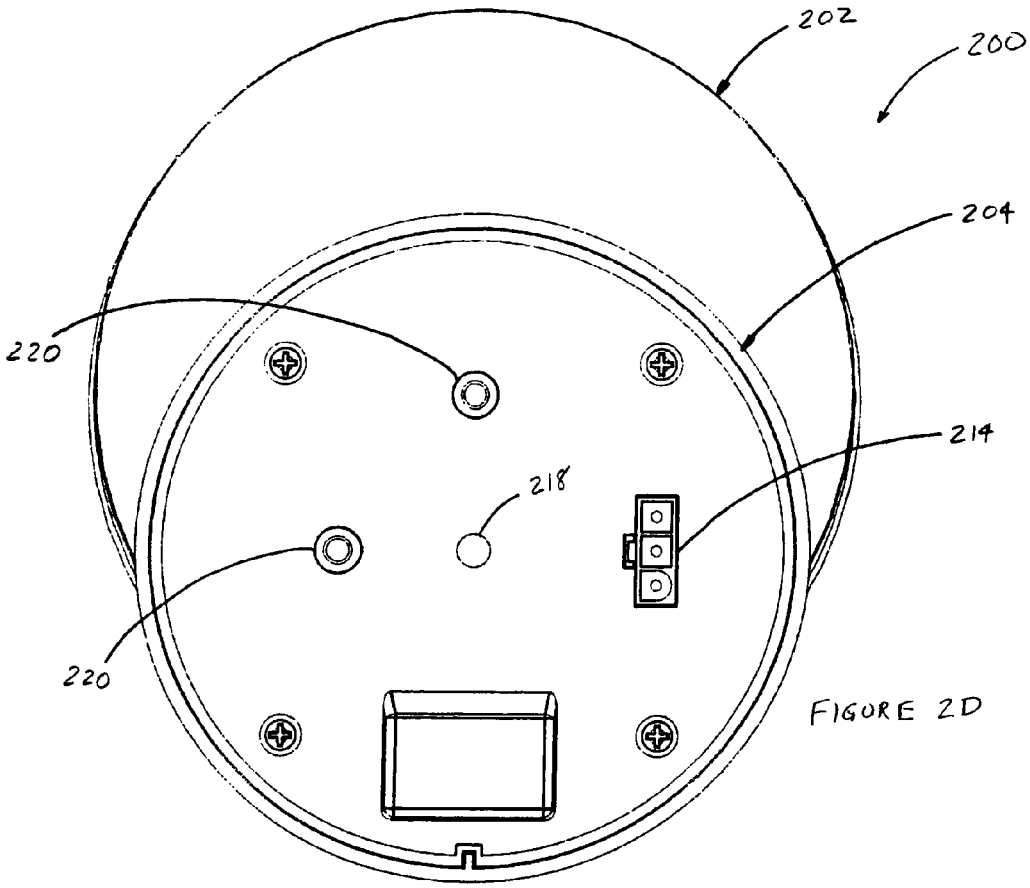
FIG. 2D illustrates a rear plan view of the exemplary luminaire in accordance with another embodiment of the invention.
Figure 2E:
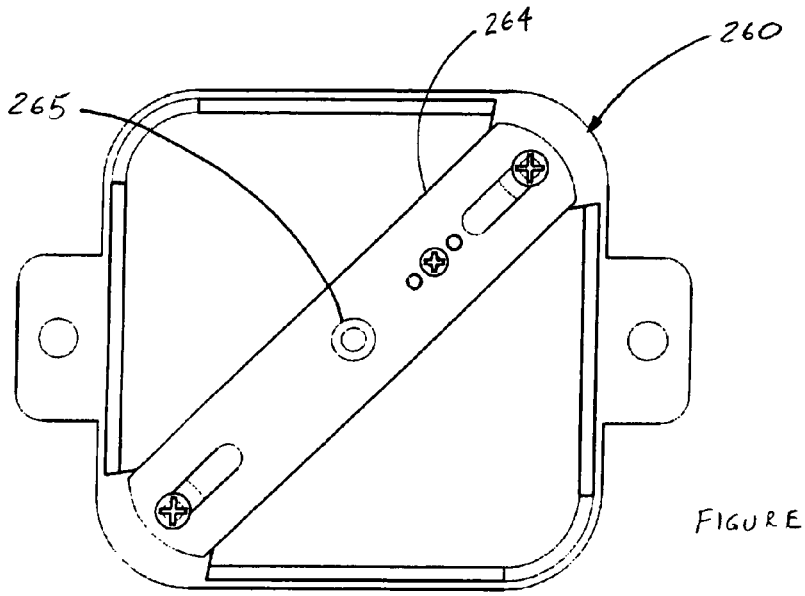
FIG. 2E illustrates a front view of an exemplary mount in accordance with another embodiment of the invention.

FIG. 2C illustrates a front perspective view of the exemplary luminaire 200 being mounted to a mount 260 in accordance with another embodiment of the invention. After the luminaire connector 214 has been easily mated with the electrical connector 250, the luminaire 200 is then mounted to the mount 260 via the bracket 264 (e.g., a junction box mounting bracket). In this regard, the base 204 includes a centralized opening 218 adapted to receive a screw or bolt 216 from the front of the luminaire 200. With reference to FIGS. 2D and 2E, which respectively illustrate the rear view of the luminaire 200 and the front view of the mount 260, the mount 260 further includes a threaded hole 265 to receive the screw or bolt 216 in order to secure the luminaire 200 to the mount 260. The base 204 may include one or more alignment members 220 (e.g., posts) to assist in the alignment of the luminaire 200 to the mount 260. In particular, when the luminaire 200 is properly aligned to the mount 260, the alignment members 220 abut the upper edge of the bracket 264 of the mount 260. The alignment members 220 also serve as positive mechanical means, which in combination with the mounting bracket, ensure that the mechanical orientation of the luminaire is maintained (e.g., maintained in a vertical orientation or maintained in a horizontal orientation). In other words, the alignment members 220 prevent the luminaire from rotating or moving out of its target orientation.

With reference back to FIG. 2C, once the screw or bolt 216 is securely mated with the corresponding threaded hole 265 of the mount 260, the cap 208 is placed over the opening 218 to hide the screw or bolt 216 for aesthetic reasons. The centralized opening 218 may be configured to securely receive the cap 208, and allow the cap 208 to be flushed with the surface of the base 204 for aesthetic and water-resistant purposes.

As discussed above, a conditional actuation device, such as a motion detector, ambient light sensor, timer, transmitter, receiver, transceiver or others, may be connected to the luminaire 200 in order to activate the luminaire 200 under one or more certain conditions. Also, as previously discussed, if no conditional actuation device is connected to the luminaire 200, the continuous actuation device 210 connects to the luminaire 200 in place of the conditional actuation device in order for the luminaire to operate as a typical light fixture. Accordingly, when a conditional actuation device is to be connected to the luminaire 200, the continuous actuation device 210 may be removed from the luminaire 200.

Figure 1:
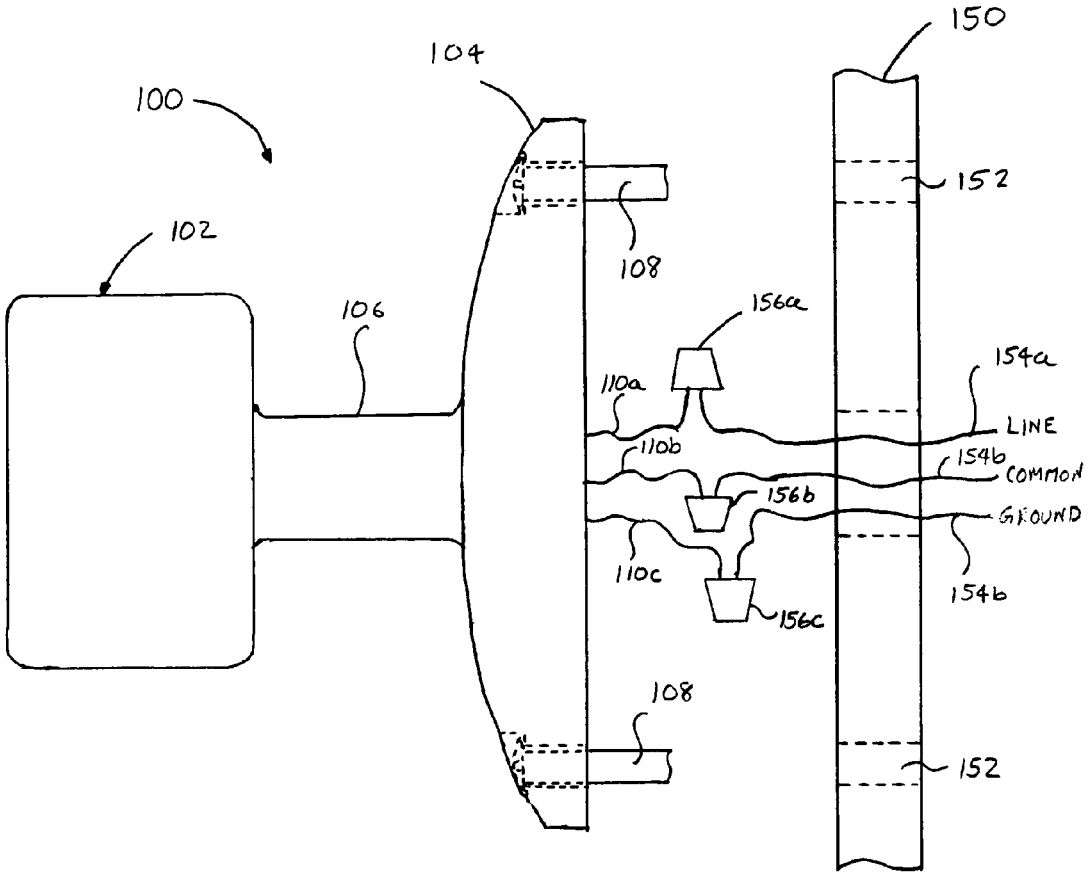
FIGURE 1 (PRIOR ART)
FIG. 1 illustrates a side view of a conventional luminaire.
Figures 2, 2F:
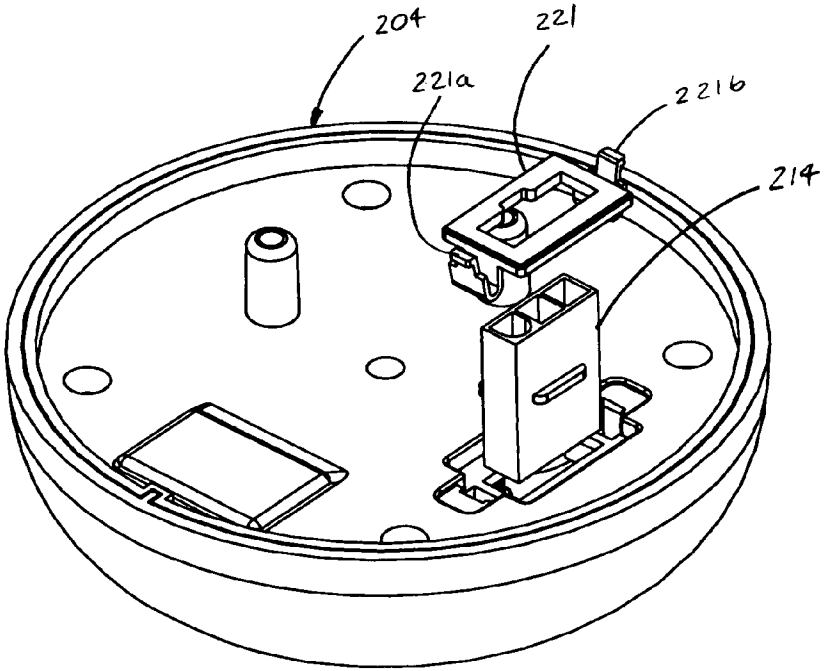
Figures 1, 2F:
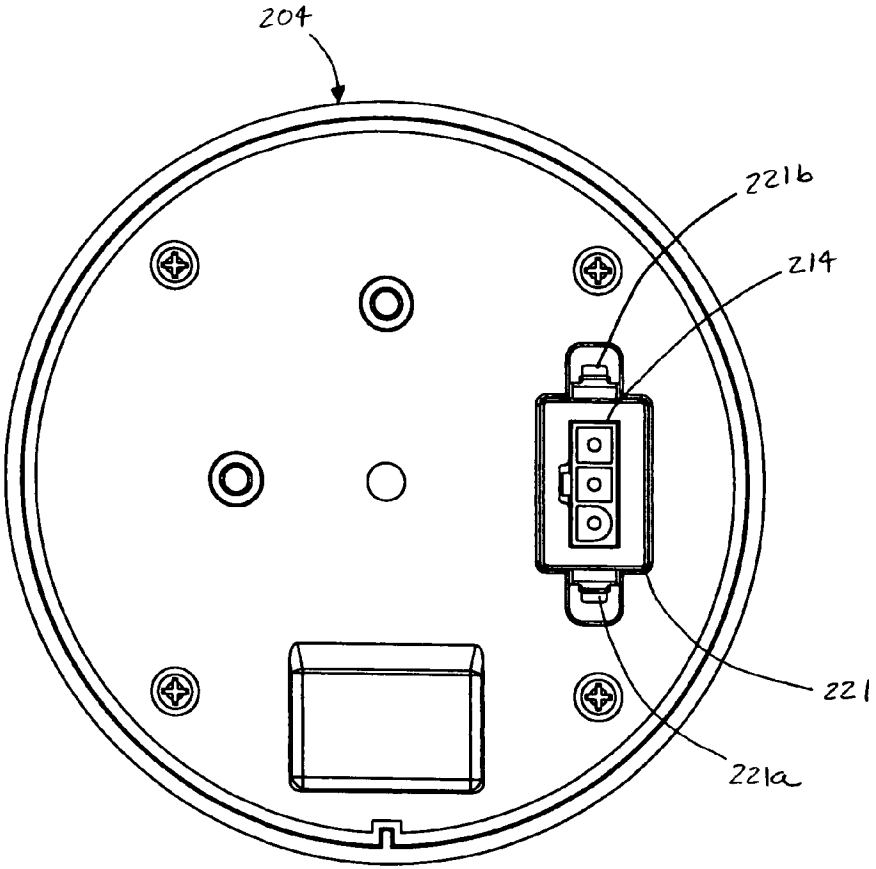

FIG. 2F-1 illustrates a perspective of the rear side of the base 204 with a removable connector holder 221 in accordance with another embodiment of the invention. The removable connector holder 221 securely attaches the connector 214 to the base 204. However, as the name suggests, the removable connector holder 221 may be removed to release the connector 214 from the base 204 as shown in FIG. 2F-2. This may facilitate the connection of the connector 214 to the corresponding electrical connector 250 in situations where the position and/or orientation of the electrical connector 250 is not conducive for mating with the secured luminaire connector 214. The removable connector holder 221 includes one or more tabs 221*a-b* to assist in the removal thereof.

Figure 2G:
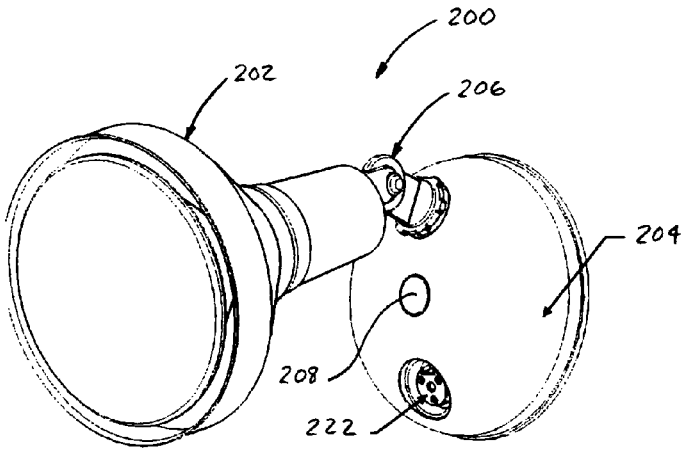
FIG. 2G illustrates a front perspective view of the exemplary luminaire with a continuous actuation device removed in accordance with another embodiment of the invention.

FIG. 2G illustrates a front perspective view of the exemplary luminaire 200 with the continuous actuation device 210 removed in accordance with another embodiment of the invention. The luminaire 200 includes an actuation device interface connector 222 adapted to connect with a corresponding connector of an actuation device. Unlike the continuous actuation device 210 which completes or causes the completion of the circuit in order for the luminaire 200 to function as a typical light fixture, the conditional actuation device completes the circuit on the basis of one or more predetermined conditions. For example, the predetermined condition may be that the actuation device detects motion, or that the ambient light is below a predetermined threshold, or that the current time is within a predetermined time window, or that it has received a transmitted signal, or others. As discussed above, in the case that the actuation device interface connector 220 and associated luminaire is normally-closed, the cap 210 may serve merely as a dummy cap to cover the connector 222 when no actuation device is connected to the luminaire 200.

Figure 2H:
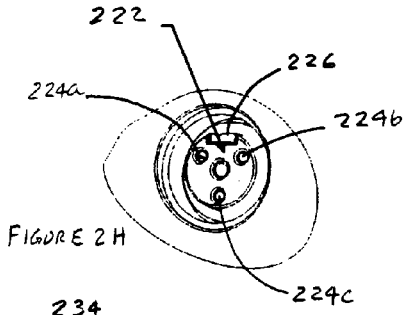
FIG. 2H illustrates a front perspective view of an exemplary actuation device interface connector of the exemplary luminaire in accordance with another embodiment of the invention.

FIG. 2H illustrates a front perspective view of an exemplary actuation device interface connector 222 of the exemplary luminaire 200 in accordance with another embodiment of the invention. As discussed above, the actuation device interface connector 222 mates with a corresponding connector of an actuation device. In particular, the connector 222 comprises three (3) female terminals 224*a-c* that are electrically connected to the luminaire line, common, and ground. The connector 222 also comprises an alignment slot 226 to assist in the proper alignment of the connector of the actuation device to the actuation device interface connector 222.

Figure 2I:
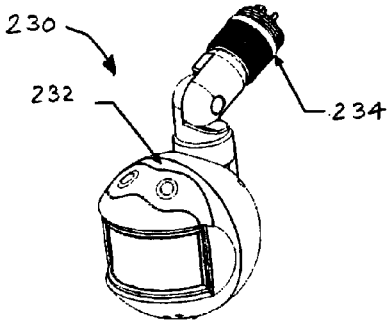
FIG. 2I illustrates a front perspective view of an exemplary motion detector in accordance with another embodiment of the invention.

FIG. 2I illustrates a front perspective view of an exemplary motion detector 230 in accordance with another embodiment of the invention. The exemplary motion detector 230 is an example of an actuation device that can interface with the luminaire 200. The motion detector 230 comprises a motion sensing head 232 pivotally mounted on a connector shaft including a connector 234.

Figure 2J:
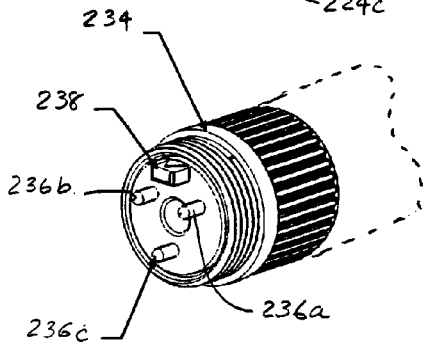
FIG. 2J illustrates a front perspective view of an exemplary connector of the exemplary motion detector in accordance with another embodiment of the invention.

FIG. 2J illustrates a front perspective view of the exemplary connector 234 of the exemplary motion sensor 230 in accordance with another embodiment of the invention. The connector 234 comprises three (3) male terminals 236*a-c* adapted to mate with the female terminals 224*a-c* (line, common, and ground) of the actuation device interface connector 222 of the luminaire 200. The connector 234 further comprises an alignment tab 238 adapted to register with the alignment slot 226 of the actuation device interface connector 224. This ensures that the male terminals 236*a-c* of the motion detector 230 mate with the proper female terminals 224*a-c* of the luminaire 200. Once the motion detector 230 is connected to the luminaire 200, the detector 230 activates the luminaire 200 upon detecting motion.

Figure 3A:
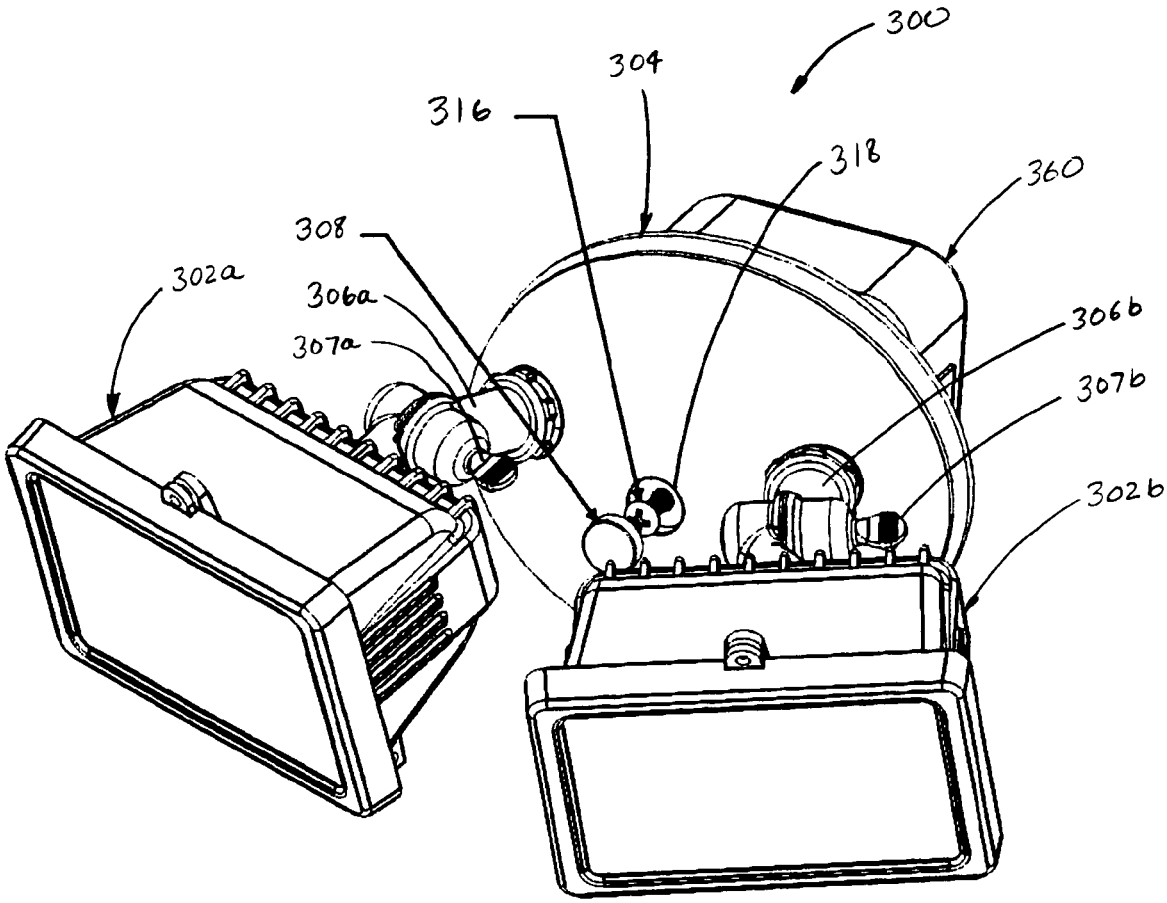
FIG. 3A illustrates a front perspective view of an exemplary dual head luminaire in accordance with another embodiment of the invention.

FIG. 3A illustrates a front perspective view of a dual head luminaire 300 in accordance with another embodiment of the invention. The luminaire 300 is similar to luminaire 200, except that luminaire 300 includes two light sources. In particular, the luminaire 300 comprises a first light source 302*a*, a second light source 302*b*, a base 304, a first neck member 306*a*, and a second neck member 306*b*. The first and second neck members 306*a* and 306*b* are securely attached to and extend outwardly from the base 304. The first and second light sources 302*a-b* are pivotally mounted to the first and second neck members 306*a-b*, respectively. The luminaire 300 may further include a first pivot adjust 307*a* to adjust the pivot orientation of the first light source 302*a*, and to secure the first light source 302*a* at the desired orientation. Similarly, the luminaire 300 may further include a second pivot adjust 307*b* to adjust the pivot orientation of the second light source 302*b*, and to secure the second light source 302*b* at the desired orientation. The luminaire 300 further includes a centralized opening 318 adapted to receive a screw or bolt 316 for mounting the luminaire 300 to a mount 360. The opening 318 may be adapted to receive a cap 308 in a manner that the cap 308 is flushed with the surface of the base 304 for aesthetic and water-resistant purposes.

Figure 3B:
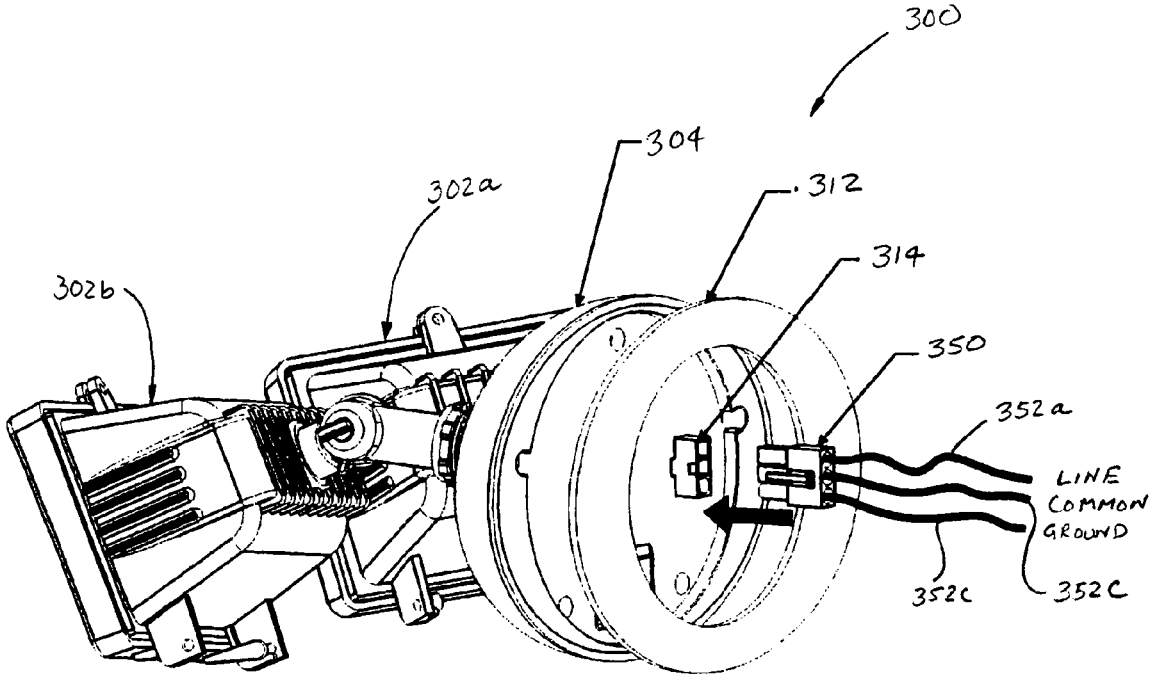
FIG. 3B illustrates a rear perspective view of the exemplary dual head luminaire in accordance with another embodiment of the invention.

FIG. 3B illustrates a rear perspective view of the dual head luminaire 300 in accordance with another embodiment of the invention. The luminaire 300 further includes a connector 314 mounted on the rear side of the base 304. The connector 314 is connected to the internal line, common, and ground wires of the luminaire 300. The connector 314 is adapted to mate with a corresponding electrical connector 350. The electrical connector 350 is connected to wires which may, in turn, be connected to the AC power source line, common, and ground wires 352*a-c* emanating from a junction box by conventional means, such as twist-on wire connectors. As previously discussed with reference to luminaire 200, the luminaire connector 314 being adapted to mate with the electrical connector 350 facilitates the installation of the luminaire 350. The luminaire 300 may further include a gasket 312 for interfacing the base 304 to the mount 360, and one or more alignment members (not shown) to facilitate the alignment of the luminaire 300 to the mount 360, and ensure that the proper orientation of the luminaire 300 is maintained. Additionally, the luminaire 300 may further include an actuation device interface connector (not shown) for connecting to an actuation device, such as a continuous actuation device, and a conditional actuation device such as a motion detector, ambient light sensor, timer, transmitter, receiver, transceiver or other device.

Figure 3C:
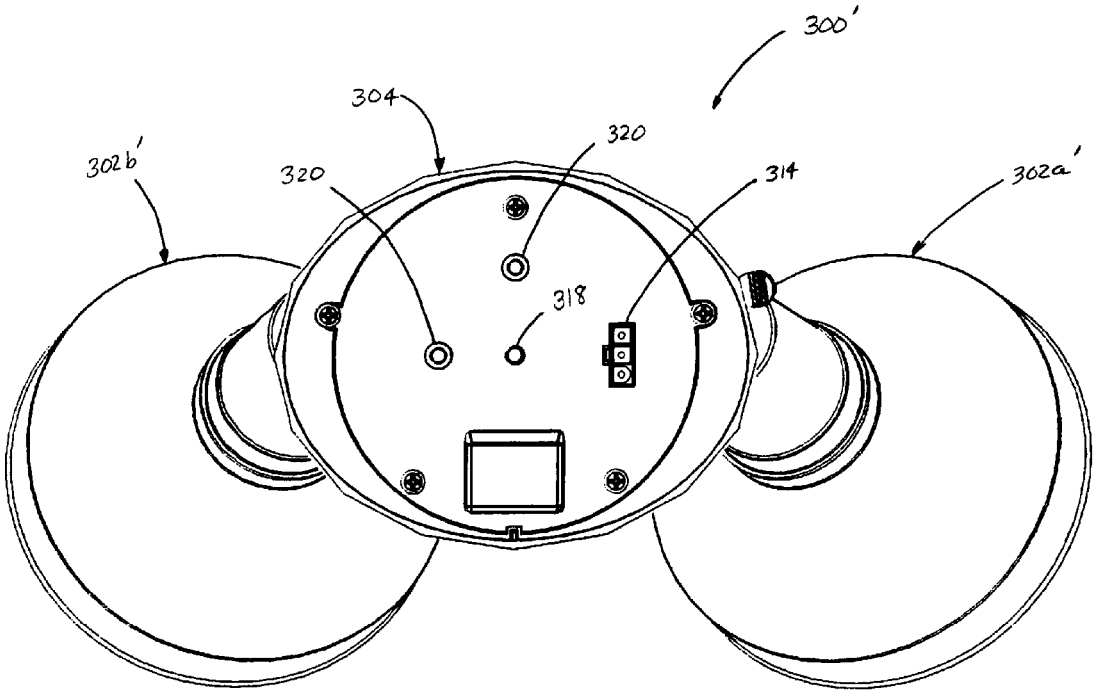
FIG. 3C illustrates a rear plan view of an exemplary dual head luminaire in accordance with another embodiment of the invention.

FIG. 3C illustrates a rear plan view of an exemplary dual head luminaire 300' in accordance with another embodiment of the invention. The dual head luminaire 300' is a variation of the dual head luminaire 300 previously discussed. The difference is that luminaire 300' includes a different style light source 302*a'-b'*. Other than that, the luminaires 300 and 300' are substantially the same. As illustrated in this view, the base 304 of the luminaire 300' includes a connector 314 for mating with a corresponding electrical connector as previously discussed. The base 304 further includes a centralized opening for receiving a screw or bolt for securing the luminaire 300' to a mount. Additionally, the base 304 further includes one or more alignment members 320 for facilitating the alignment of the luminaire 300' to the mount.

Figure 4:
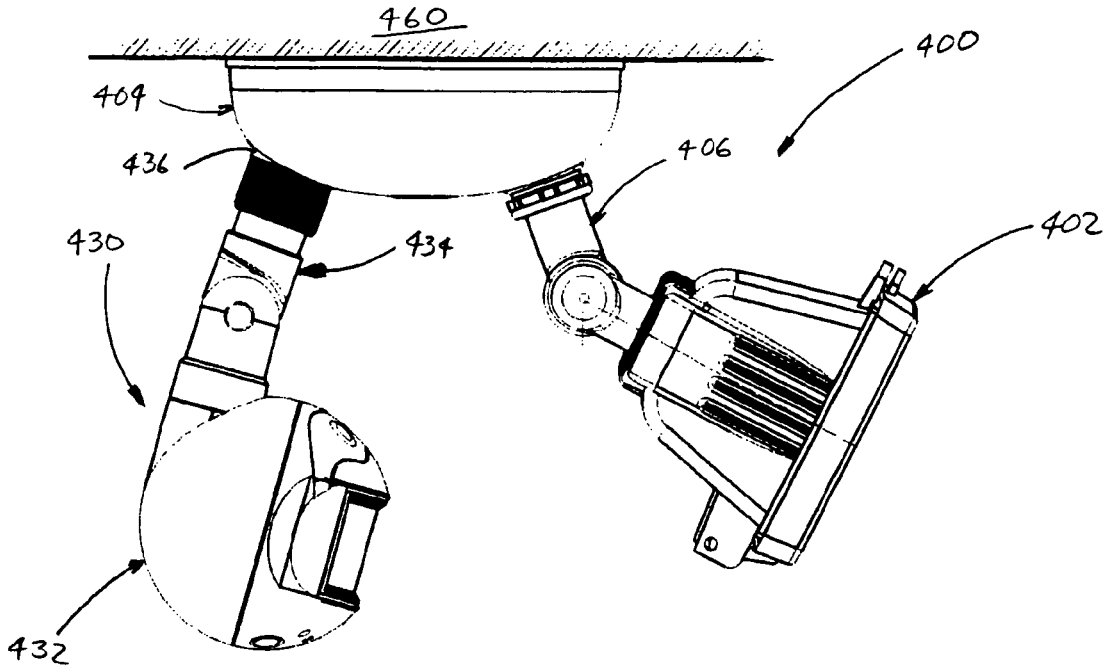
FIG. 4 illustrates a side view of an exemplary ceiling-mountable luminaire and attached motion detector in accordance with another embodiment of the invention.

FIG. 4 illustrates a side view of an exemplary ceiling-mountable luminaire 400 and attached motion detector 430 in accordance with another embodiment of the invention. In this exemplary embodiment, the luminaire 400 is mounted on junction box in the ceiling 460. Similar to the previously-discussed luminaires 200-300, the luminaire 400 comprises a light source 402 pivotally mounted on a neck member 406 that extends from a base 404. The base 404 may include a connector (not shown) connected to the internal wires (line, common, and ground) of the luminaire 400, for connection to a corresponding electrical connector connected to the AC power source wires (line, common, and ground), as previously discussed. The luminaire 400 also includes a connector for connecting to an actuation device, such as the motion detector 430. The motion detector 430 includes a motion sensing head 432 pivotally mounted to a shaft 434 having a connector 436 for mating with a corresponding connector of the luminaire 400. The shaft 434 is also rotatable so that the sensing head 432 may be rotated to a desired orientation. In this exemplary embodiment, the pivot orientation of both the light source 402 and the motion sensor 430 may be adjusted as desired.

Figure 5A:
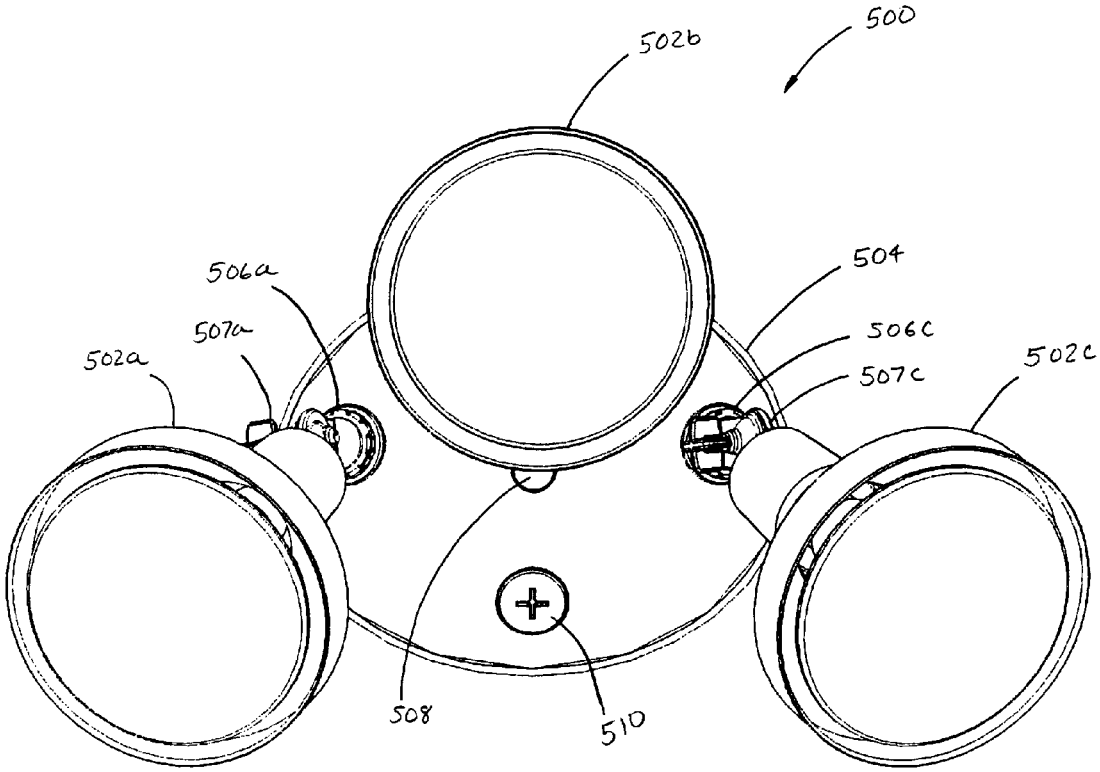
FIG. 5A illustrates a front plan view of an exemplary triple head luminaire in accordance with another embodiment of the invention.

FIG. 5A illustrates a front perspective view of an exemplary triple head luminaire 500 in accordance with another embodiment of the invention. The luminaire 500 is similar to the previously-discussed luminaires 200 and 300, except that luminaire 500 includes three (3) light sources. In particular, the luminaire 500 comprises a first light source 502*a*, a second light source 502*b*, a third light source 502*c*, a base 504, a first neck member 506*a*, a second neck member (not shown), and a third neck member 506*c*. The first, second, and third neck members are securely attached to and extend outwardly from the base 504. The first, second, and third light sources 502*a-c* are pivotally mounted to the first, second, and third neck members, respectively. The luminaire 500 may further include first, second, and third pivot adjusts (only 507*a* and *c* are shown) to respectively adjust the pivot orientations of the first, second, and third light source 502*a-c*. The luminaire 500 further includes a centralized opening 518 adapted to receive a screw or bolt 516 for mounting the luminaire 500 to a mount. The opening 518 may be adapted to receive a cap 508 in a manner that the cap 508 is flushed with the surface of the base 504 for aesthetic and water-resistant purposes. The luminaire 500 further includes a continuous actuation device 510 connected to a corresponding connector of the luminaire 500.

Figure 5B:
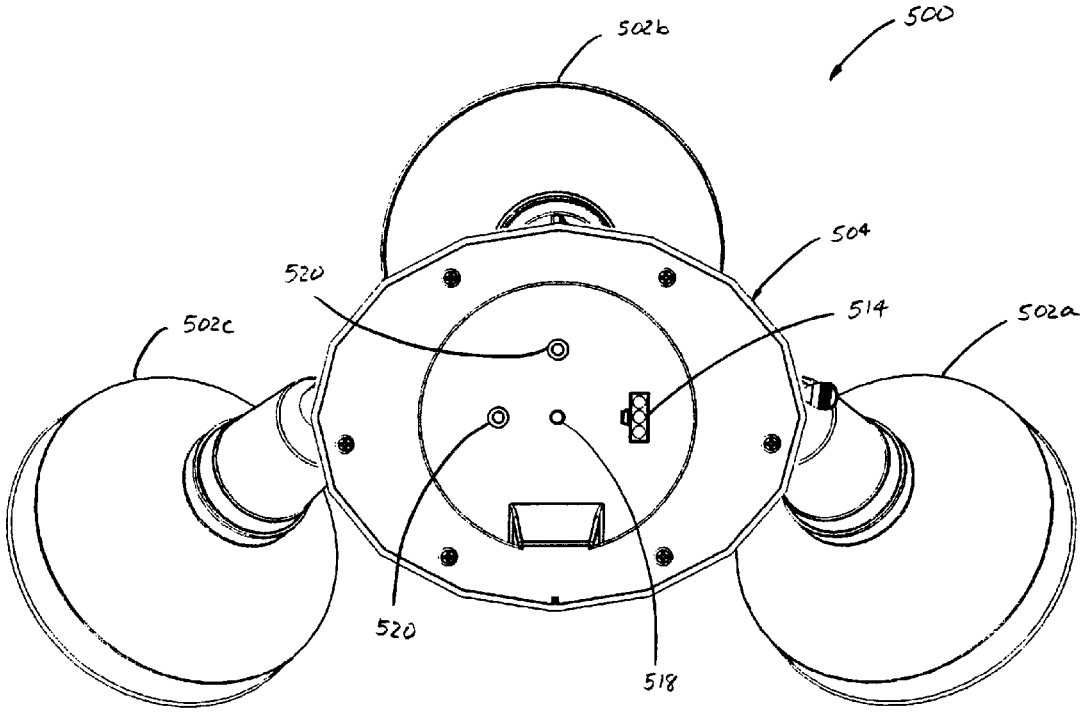
FIG. 5B illustrates a rear plan view of the exemplary triple head luminaire in accordance with another embodiment of the invention.

FIG. 5B illustrates a rear plan view of the exemplary triple head luminaire 500 in accordance with another embodiment of the invention. Similar to the previously-discussed luminaires 200 and 300, the base 504 of the luminaire 500 includes a connector 514 for mating with a corresponding electrical connector as previously discussed. The base 504 further includes the centralized opening 518 for receiving a screw or bolt for securing the luminaire 500 to a mount. Additionally, the base 504 further includes one or more alignment members 520 for facilitating the alignment of the luminaire 500 to the mount, and ensuring that the proper orientation of the luminaire 500 is maintained.

Another advantage of the various embodiments described above is that if the actuation device fails for any particular reason, or if the user merely wants to change the existing actuation device for another actuation device (same or different type), the user merely detaches the existing actuation device from the luminaire, and attaches a new actuation device or the repaired existing actuation device to the luminaire. Thus, the luminaires described herein facilitate the maintenance, repair, and upgrade of the luminaires.

Figure 6A:
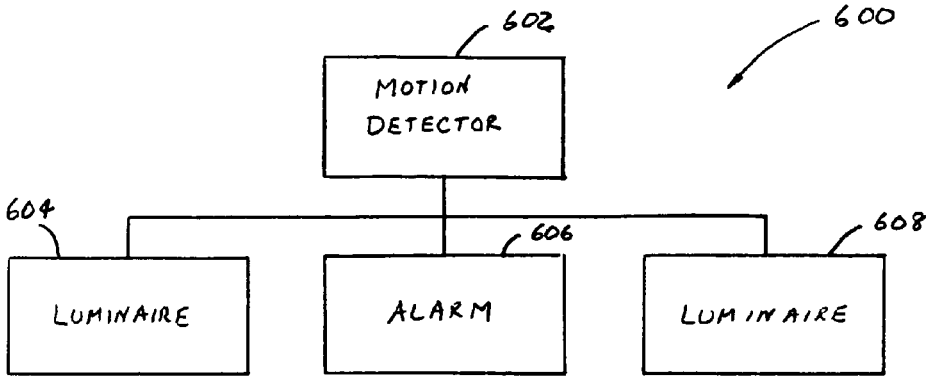
FIG. 6A illustrates a block diagram of an exemplary security system in accordance with another embodiment of the invention.

FIG. 6A illustrates a block diagram of an exemplary security system 600 in accordance with another embodiment of the invention. The security system 600 comprises a motion detector 602 (or other type of actuation device, such as a photo beam detector), one or more luminaires 604 and 608, and an alarm 606. The security system 600 may be used to secure any predetermined location, such as a residence, commercial building, or restricted outdoor area. The motion detector 602 is coupled to the luminaires 604 and/or 608, and the alarm 606 via a wired connection, wireless connection, or combination thereof. In operation, when the motion detector 602 senses motion in its proximate area, the motion detector 602 causes the activation of the luminaires 604 and/or 608, and/or the alarm 606. This may be accomplished by the motion detector 602 sending an activation signal by way of the wired and/or wireless connection to the luminaires 604 and/or 608, and/or the alarm 606.

Figure 6B:
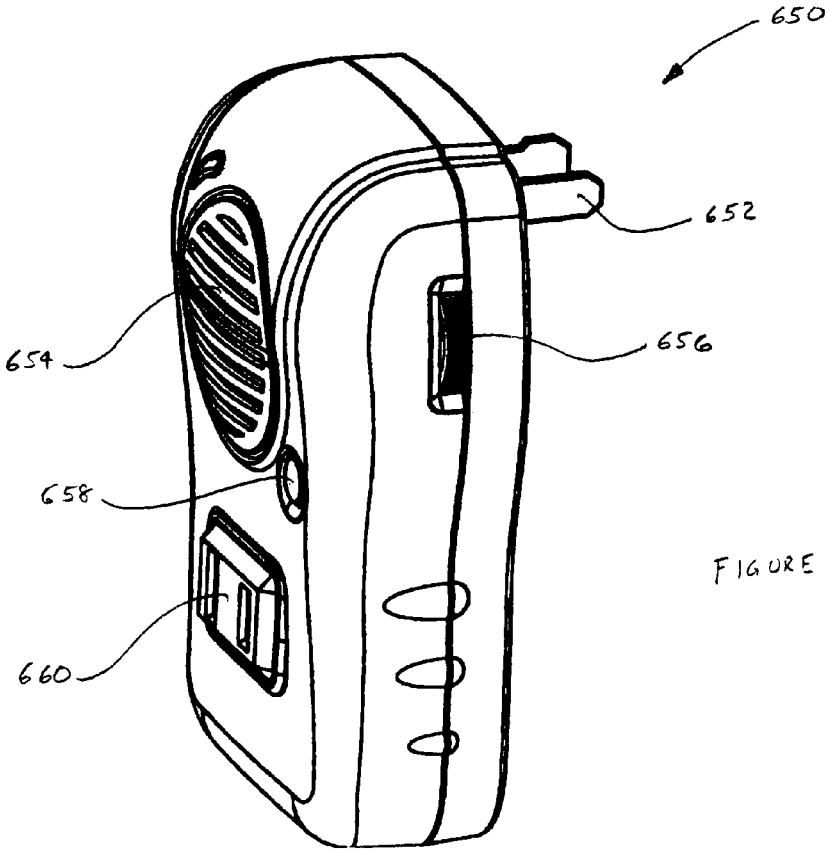
FIG. 6B illustrates a perspective view of an exemplary alarm in accordance with another embodiment of the invention.
Figure 3B:
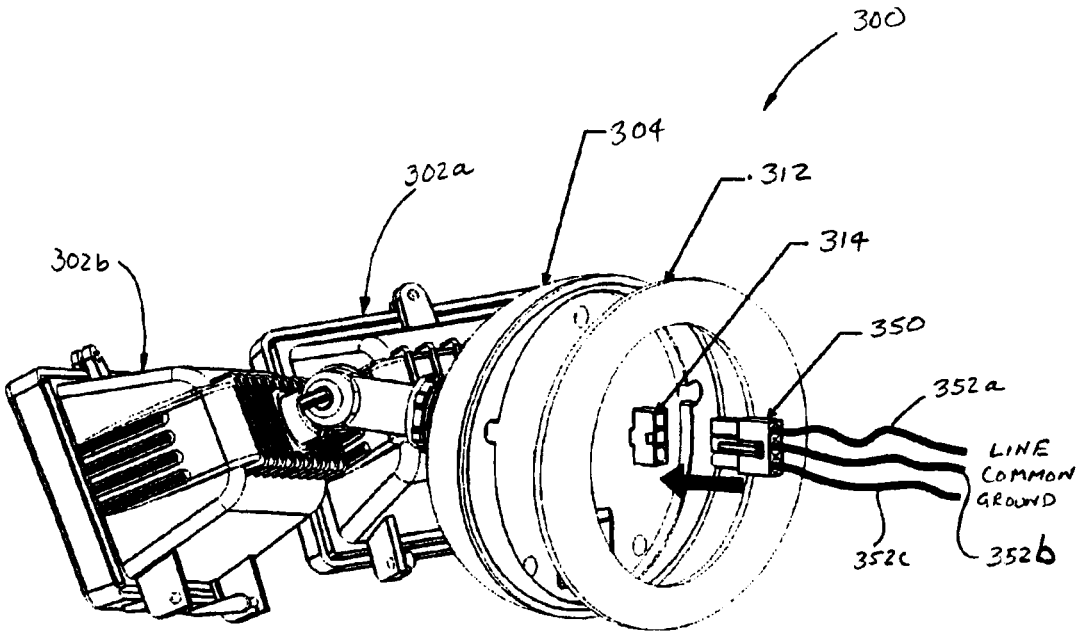

FIG. 6B illustrates a front perspective view of an exemplary alarm 650 in accordance with another embodiment of the invention. The alarm 650 may be an exemplary detailed version of the alarm 606 of the security system 600, as discussed above. The alarm 650 may comprise an AC power plug 652, a speaker 654, an ON/OFF and volume control 656, and an AC power outlet 660. Although not shown, the alarm 650 may include a tone selector for selecting the desired tone for the alarm, and a manual/automatic mode switch which allows for the manual operation of an appliance (e.g., a light source) plugged into the AC power outlet 660. As discussed above, the alarm 650 may be wired or wirelessly coupled to the motion detector 602 or other actuation device.

An advantage of the luminaires, actuation devices, and security system discussed above is that they provide consumers the flexibility to configure a security and/or lighting system as desired. Therefore, a supplier, for example, a wholesale or retail store, may offer luminaires with different styles of light sources; different types of actuation devices, such as motion detectors, ambient light sensors, timers, transmitters, receivers, transceivers and others; and optional alarms. A consumer may make the appropriate selection of these devices in any combination thereof to custom design a security and/or lighting system.

For example, a particular consumer may only desire to use a luminaire for continuous lighting purposes responsive to an ON/OFF switch. Such consumer may select a luminaire with a particular style of light source, and connect a continuous actuation device to it so that the luminaire operates as a typical light fixture. Another consumer may desire to use the luminaire for night time applications. In such a case, the consumer may select a luminaire with a particular style of light source, and connect an ambient light sensor or timer so that the luminaire turns ON and OFF when it gets dark and light, respectively. Yet another consumer may desire to use the luminaire for security purposes. In such a case, the consumer may select a luminaire with a particular style of light source, and connect a motion detector to it so that the luminaire turns ON when motion is detected in a particular area. Still, the consumer may want additional security, and further connect an alarm to the luminaire and motion detector as per security system 600 discussed above.

While the invention has been described in connection with an exemplary embodiment, it will be understood that the invention is capable of further modifications. This application is intended to cover any variations, uses or adaptation of the invention following, in general, the principles of the invention, and including such departures from the present disclosure as come within the known and customary practice within the art to which the invention pertains.

What is claimed is:

1. A luminaire, comprising: a light source attached to and supported on a base, the base with the attached light source directly securable to a junction box or junction box bracket in or on a wall or ceiling and a first connector extendable out of or mounted on the back side of the base including a line wire, a common wire and a ground wire extending from the back of the base to the first connector, the ground wire and at least one of the line wire or common wire directly connected to the light source without an intervening plug-in style connector for supplying alternating current (AC) power to the light source, wherein said first connector is adapted to mate directly with a corresponding second connector without any external wire connection between the first and second connectors, the second connector wired directly to a line wire, common wire and ground wire of an alternating current (AC) power source, the second connector with its line, common and ground wires in or extendable out of the junction box, the mated first and second connectors and their respective line, common and ground wires residing in the junction box when the luminaire is secured to the junction box.

2. The luminaire of claim 1, wherein said first connector and said second connector comprise a male-female plug-in style connector.

3. The luminaire of claim 1 further comprising a supporting neck member having two opposing ends attached at one end to said base and mounted at the other end to said light source.

4. The luminaire of claim 3, wherein said light source is pivotally mounted on said neck member.

5. The luminaire of claim 4, wherein said light source is pivotally mounted to said neck member with a pivot adjust for adjusting an orientation of said light source.

6. The luminaire of claim 1 wherein said first connector is mounted on the back side of said base.

7. The luminaire of claim 6, wherein said luminaire includes a connector holder for securing said first connector to said base and releasing said first connector from said base.

8. The luminaire of claim 1 wherein said base includes one or more openings in the front of the base open to the interior of the base adapted to receive one or more screws or bolts for securing said luminaire to the junction box.

9. The luminaire of claim 1, further comprising a third connector on the front side of said base adapted to receive an actuation device for actuating said light source.

10. The luminaire of claim 9, wherein said actuation device comprises a continuous actuation device.

11. The luminaire of claim 9, wherein said actuation device comprises a conditional actuation device.

12. The luminaire of claim 9, wherein said third connector and associated circuitry is normally-closed allowing said light source to be normally activated, and wherein connection of an actuation device to said third connector opens said normally-closed circuitry until said actuation device activates said light source.

13. The luminaire of claim 8 wherein the junction box has a junction box bracket for mounting of a luminaire directly to the junction box.

14. A method of installing a luminaire to a junction box in or on a wall or ceiling, the luminaire including a base with an attached light source supported by the base and a first connector mounted on or extendable from the back side of the base, the first connector having a line wire, a common wire and a ground wire extending from the back of the base to the first connector, at least one of the line wire or common wire and ground wire directly connected to the light source without an intervening plug-in style connector for supplying alternating current (AC) power to the light source, the method comprising: directly connecting said first connector to a second connector without any external wire connection between the first and second connectors, the second connector mounted in or extendable from a junction box and connected directly to the junction box line wire, a common wire and a ground wire of an alternating current (AC) power source; and directly mounting said luminaire onto a junction box after connecting the first and second connectors with the connected first and second connectors and their respective line, common and ground wires positioned within the junction box when the luminaire is mounted to the junction box, said first and second connectors comprising plug in-style connectors.

15. The method of claim 14, wherein connecting said first connector to said second connector comprises plugging said second connector into said first connector.

16. The method of claim 14, wherein connecting said first connector to said second connector comprises plugging said first connector into said second connector.

17. The method of claim 14, further comprising connecting the line wire, the common wire and the ground wire of said second connector to a line wire, a common wire and a ground wire, respectively, of an alternating current (AC) power source prior to connecting said first connector to said second connector.

18. The method of claim 14, wherein mounting said luminaire to said junction box comprises: inserting a screw or bolt into an opening of said base open to the interior of said base, and extending said screw or bolt through the base; and threading said screw or bolt into a threaded hole of said junction box.

19. The method of claim 14, wherein said luminaire includes a third connector on its front side and an actuation device, the actuation device connected to the third connector, the third connector powered by the alternating current (AC) power source via the first and second connectors.

20. The method of claim 14 wherein the junction box has a junction box bracket for mounting of a luminaire directly to the junction box.

21. The method of claim 20, wherein mounting said luminaire to said junction box comprises: inserting a screw or bolt into an opening of said base open to the interior of said base, and extending said screw or bolt through the base; and threading said screw or bolt into a threaded hole of the junction box bracket.

22. A luminaire, comprising: a light source mounted and supported on a luminaire base adapted to be secured directly to a junction box or a junction box bracket in or on a wall or ceiling; a first connector mounted on or extendable out of the back side of the luminaire base for connecting to line, common, and ground wires of an alternating current (AC) power source, said first connector connected directly to the light source without an intervening plug-in style connector by a ground wire and at least one of a line wire, or a common wire; and a second connector mounted in or extendable out of a junction box connected directly to a line wire, a common wire, and a ground wire of an alternating current (AC) power source, wherein said second connector is adapted to mate with said first connector in a plug-in style relationship without any external wire connection between the first and second connectors.

23. The luminaire of claim 22, further comprising a plug-in style third connector on the exterior of the luminaire base to mate with a connector of an actuation device mounted on the exterior of the luminaire base and adapted to actuate said light source.

24. The luminaire of claim 8, further comprising a gasket for interfacing the periphery of the junction box to said base.

25. The luminaire of claim 2, wherein said first connector is mounted on the back side of the base.

26. The method of claim 14, wherein connecting said first connector to said second connector comprises plugging said second connector into said first connector.

27. The method of claim 14, wherein connecting said first connector to said second connector comprises plugging said first connector into said second connector.

28. A method of installing a luminaire to a junction box in or on a wall or ceiling, the luminaire including a base with an attached light source supported by the base and a first connector mounted on or extendable from the back side of the base, the first connector having a line wire, a common wire and a ground wire extending from the back of the base to the first connector, at least one of the line wire or common wire and ground wire directly connected to the light source without an intervening plug-in style connector for supplying alternating current (AC) power to the light source, the method comprising: directly connecting said first connector to a second connector without any external wire connection between the first and second connectors, the second connector mounted in or extendable from a junction box and connected to the junction box line wire, a common wire and a ground wire of an alternating current (AC) power source; and directly mounting said luminaire onto a junction box after connecting the first and second connectors with the connected first and second connectors and their respective line, common and ground wires positioned within the junction box when the luminaire is mounted to the junction box, said first and second connectors comprising plug in-style connectors.

29. The method of claim 28, wherein connecting said first connector to said second connector comprises plugging said second connector into said first connector.

30. The method of claim 28, wherein connecting said first connector to said second connector comprises plugging said first connector into said second connector.

31. The method of claim 28, further comprising connecting the line wire, the common wire and the ground wire of said second connector to a line wire, a common wire and a ground wire, respectively, of an alternating current (AC) power source prior to connecting said first connector to said second connector.

32. The method of claim 28, wherein mounting said luminaire to said junction box comprises: inserting a screw or bolt into an opening of said base open to the interior of said base, and extending said screw or bolt through the base; and threading said screw or bolt into a threaded hole of said junction box.

33. The method of claim 28, wherein said luminaire includes a third connector on its front side and an actuation device, the actuation device connected to the third connector, the third connector powered by the alternating current (AC) power source via the first and second connectors.

34. The method of claim 28, wherein the junction box has a junction box bracket for mounting of a luminaire directly to the junction box.

35. The method of claim 34, wherein mounting said luminaire to said junction box comprises: inserting a screw or bolt into an opening of said base open to the interior of said base, and extending said screw or bolt through the base; and threading said screw or bolt into a threaded hole in a junction box bracket.

36. A luminaire, comprising: a light source mounted and supported on a luminaire base adapted to be secured directly to a junction box or junction box bracket in or on a wall or ceiling; a first connector mounted on or extending out of the back side of the luminaire base for connecting to line, common, and ground wires of an alternating current (AC) power source, said first connector connected directly to the light source without an intervening plug-in style connector by a ground wire and at least one of a line wire, or a common wire; and a second connector mounted in or extendable out of a junction box connected to a line wire, a common wire, and a ground wire of an alternating current (AC) power source, wherein said second connector is adapted to mate with said first connector in a plug-in style relationship without any external wire connection between the first and second connectors.

37. The luminaire of claim 36, further comprising a plug-in style third connector on the exterior of the luminaire base to mate with a connector of an actuation device mounted on the exterior of the luminaire base and adapted to actuate said light source.

38. A luminaire, comprising: a light source attached to and supported on a base, the base with the attached light source directly securable to a junction box or junction box bracket in or on a wall or ceiling and a first connector extendable out of or mounted on the back side of the base including a line wire, a common wire and a ground wire extending from the back of the base to the first connector, the ground wire and at least one of the line wire or common wire directly connected to the light source without an intervening plug-in style connector for supplying alternating current (AC) power to the light source, wherein said first connector is adapted to mate directly with a corresponding second connector without any external wire connection between the first and second connectors, the second connector wired to a line wire, common wire and ground wire of an alternating current (AC) power source, the second connector with its line, common and ground wires in or extendable out of the junction box, the mated first and second connectors and their respective line, common and ground wires residing in the junction box when the luminaire is secured to the junction box.

39. The luminaire of claim 38, wherein said first connector and said second connector comprise a male-female plug-in style connector.

40. The luminaire of claim 38 further comprising a supporting neck member having two opposing ends attached at one end to said base and mounted at the other end to said light source.

41. The luminaire of claim 40, wherein said light source is pivotally mounted on said neck member.

42. The luminaire of claim 41, wherein said light source is pivotally mounted to said neck member with a pivot adjust for adjusting an orientation of said light source.

43. The luminaire of claim 38, wherein said first connector is mounted on the back side of said base.

44. The luminaire of claim 43, wherein said luminaire includes a connector holder for securing said first connector to said base and releasing said first connector from said base.

45. The luminaire of claim 38, wherein said base includes one or more openings in the front of the base open to the interior of the base adapted to receive one or more screws or bolts for securing said luminaire to the junction box.

46. The luminaire of claim 38, further comprising a third connector on the front side of said base adapted to receive an actuation device for actuating said light source.

47. The luminaire of claim 46, wherein said actuation device comprises a continuous actuation device.

48. The luminaire of claim 46, wherein said actuation device comprises a conditional actuation device.

49. The luminaire of claim 46, wherein said third connector and associated circuitry is normally-closed allowing said light source to be normally activated, and wherein connection of an actuation device to said third connector opens said normally-closed circuitry until said actuation device activates said light source.

50. The luminaire of claim 45, wherein the junction box has a junction box bracket for mounting of a luminaire directly to the junction box.

51. The luminaire of claim 44, wherein said first connector is mounted on the back side of the base.

52. The luminaire of claim 45, further comprising a gasket for interfacing the periphery of the junction box to said base.

53. A luminaire, secured on a junction box comprising: a luminaire with a light source; attached to and supported on a luminaire base; and a junction box in or on a wall or ceiling, the luminaire base with the attached light source directly secured to the junction box or junction box bracket, a line wire, a common wire and a ground wire extending from the back of the base and electrically connecting the light source to a first connector, the ground wire and at least one of the line wire or common wire directly connected to the light source without an intervening plug-in style connector for supplying alternating current (AC) power to the light source, said first connector connected directly with a corresponding second connector without any external wire connection between the first and second connectors, the second connector electrically connected to a line wire, common wire and ground wire of an alternating current (AC) power source in the junction box, the connected first and second connectors and their respective line, common and ground wires enclosed in the junction box.

54. The luminaire of claim 53, wherein said first connector and said second connector comprise a male-female plug-in style connector.

55. The luminaire of claim 54 further comprising a supporting neck member having two opposing ends attached at one end to said base and mounted at the other end to said light source.

56. The luminaire of claim 55, wherein said light source is pivotally mounted on said neck member.

57. The luminaire of claim 56, wherein said light source is pivotally mounted to said neck member with a pivot adjust for adjusting an orientation of said light source.

58. The luminaire of claim 57, wherein said first connector is mounted on the back side of said base.

59. The luminaire of claim 58, wherein said luminaire includes a connector holder for securing said first connector to said base and releasing said first connector from said base.

60. The luminaire of claim 53 wherein said base includes at least one opening in the front of the base open to the interior of the base through which a screw or bolt extends and engages the junction box or junction box bracket for securing said luminaire to the junction box.

61. The luminaire of claim 53, further comprising a third connector on the front side of said base adapted to receive an actuation device for actuating said light source.

62. The luminaire of claim 61, wherein said actuation device comprises a continuous actuation device.

63. The luminaire of claim 61, wherein said actuation device comprises a conditional actuation device.

64. The luminaire of claim 61, wherein said third connector and associated circuitry is normally-closed allowing said light source to be normally activated, and wherein connection of an actuation device to said third connector opens said normally-closed circuitry until said actuation device activates said light source.

65. The luminaire of claim 54, wherein said first connector is mounted on the back side of the base.

66. The luminaire of claim 60, further comprising a gasket for interfacing the periphery of the junction box to said base.

* * * * *

UNITED STATES PATENT AND TRADEMARK OFFICE

CERTIFICATE OF CORRECTION

PATENT NO. : 7,985,017 B2
APPLICATION NO. : 11/319036
DATED : July 26, 2011
INVENTOR(S) : Jon Fong Quan et al.

It is certified that error appears in the above-identified patent and that said Letters Patent is hereby corrected as shown below:

Delete the title page showing an illustrative figure and substitute the attached title page therefor.

In the drawings, Sheet 1, Fig. 1, the reference numeral "154b" applied to the ground wire should read -- 154c --, therefor.

In the drawings, delete Sheet 9 showing Fig. 3B, and substitute the attached Sheet 9, therefor.

In the drawings, Sheet 14, Fig. 6B, delete the reference numeral "658", therefor.

In column 3, line 18, delete "that be understood", therefor.

In column 8, line 27, delete "luminaire 350" and insert -- luminaire 300 --, therefor.

Signed and Sealed this
Twenty-second Day of November, 2011

David J. Kappos

David J. Kappos
*Director of the United States Patent and Trademark Office*

(12) United States Patent
Quan et al.

(10) Patent No.: US 7,985,017 B2
(45) Date of Patent: Jul. 26, 2011

(54) LUMINAIRE HAVING PLUG-IN STYLE ELECTRICAL CONNECTOR, AND A SEPARATELY PLUG-IN MOUNTABLE MOTION DETECTOR OR OTHER ACTUATION DEVICE

(75) Inventors: Jon Fong Quan, Foothill Ranch, CA (US); Michael D. Faubert, Foothill Ranch, CA (US); Michael G. Kreeger, Foothill Ranch, CA (US)

(73) Assignee: Hampton Products International Corporation, Foothill Ranch, CA (US)

( * ) Notice: Subject to any disclaimer, the term of this patent is extended or adjusted under 35 U.S.C. 154(b) by 589 days.

(21) Appl. No.: 11/319,036

(22) Filed: Dec. 27, 2005

(65) Prior Publication Data

US 2006/0193151 A1 Aug. 31, 2006

Related U.S. Application Data

(60) Provisional application No. 60/640,109, filed on Dec. 28, 2004.

(51) Int. Cl.
*F21V 23/06* (2006.01)

(52) U.S. Cl. ..... 362/659; 362/657; 362/658; 362/647

(58) Field of Classification Search ..... 362/659, 362/657, 658, 647, 640, 642; 307/147, 157; 439/537

See application file for complete search history.

(56) References Cited

U.S. PATENT DOCUMENTS

| | | | | |
|---|---|---|---|---|
| 3,382,355 | A * | 5/1968 | Prifogle et al. | 362/641 |
| 3,695,009 | A * | 10/1972 | Osteen | 96/147 |
| 4,367,417 | A * | 1/1983 | Casasanta | 307/147 |
| 4,475,226 | A * | 10/1984 | Greenberg | 381/300 |
| 4,721,480 | A * | 1/1988 | Yung | 439/527 |
| 6,641,278 | B1 * | 11/2003 | Guritz | 362/148 |
| 6,780,049 | B1 * | 8/2004 | D'Angelo et al. | 439/537 |
| 6,956,493 | B1 * | 10/2005 | Youngblood | 340/693.9 |
| 6,962,498 | B2 * | 11/2005 | Kohen | 439/21 |

* cited by examiner

*Primary Examiner* – Sharon E Payne

(57) ABSTRACT

A luminaire including a light source mounted on a base having a plug-in style connector attached to the internal wires of the luminaire for supplying AC power to the light source. The connector is adapted to mate with a plug-in style connector connected to wires of a J-box. The luminaire may include a second connector for connecting to a conditional actuation device. If the conditional actuation device is not used, a continuous actuation device may be connected to the luminaire. A method of installing a luminaire includes connecting an electrical connector to the wires for connection to a J-box, connecting the luminaire connector to the electrical connector, and mounting the luminaire onto the J-box. A method of selling includes providing a choice from among different style luminaires, providing a choice from among different actuation devices to connect with the selected luminaire, and optionally selling the selected luminaire and actuation device. Methods of replacing and repairing an actuation device are also disclosed.

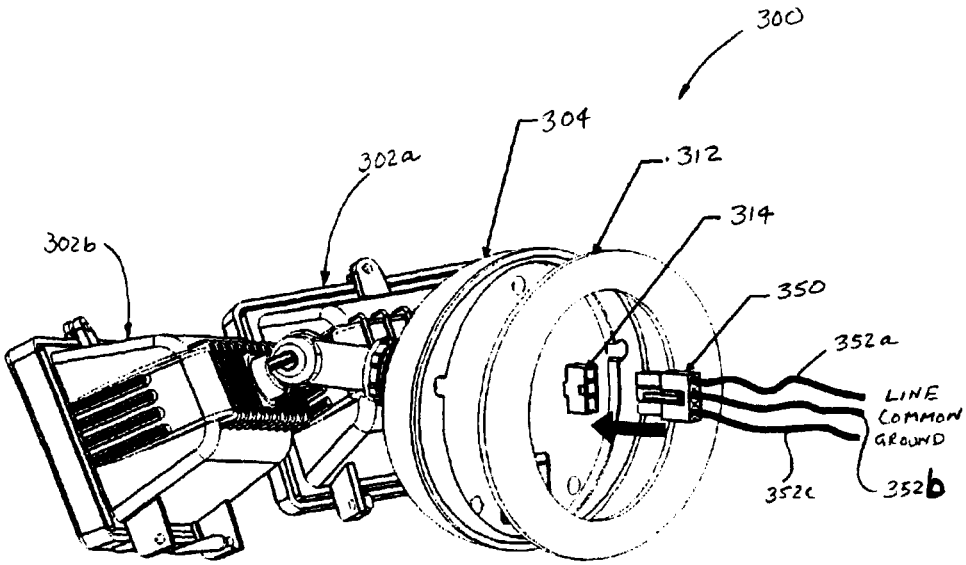

66 Claims, 14 Drawing Sheets